US006381431B1

(12) United States Patent
Kinoshita et al.

(10) Patent No.: US 6,381,431 B1
(45) Date of Patent: Apr. 30, 2002

(54) CHARGING APPARATUS INCLUDING A MAGNETIC BRUSH WITH LOCAL ANTI-CONTAMINATION FEATURE

(75) Inventors: Masahide Kinoshita, Shizuoka-ken; Seiji Yamaguchi, Numazu, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/632,013

(22) Filed: Jul. 31, 2000

(30) Foreign Application Priority Data

Jul. 29, 1999 (JP) ..... 11-215081
Jul. 29, 1999 (JP) ..... 11-215082

(51) Int. Cl.[7] ..... G03G 15/02
(52) U.S. Cl. ..... 399/175
(58) Field of Search ..... 399/149, 150, 399/174–176

(56) References Cited

U.S. PATENT DOCUMENTS 5,367,365 A * 11/1994 Haneda et al. ..... 399/174
5,606,401 A 2/1997 Yano
6,026,260 A * 2/2000 Aita et al. ..... 399/175

* cited by examiner

*Primary Examiner*—William J. Royer
(74) *Attorney, Agent, or Firm*—Fitzpatrick, Cella, Harper & Scinto

(57) ABSTRACT

A charging apparatus includes magnetic particles for rubbing with a member to be charged to electrically charge the member to be charged; a rotatable magnetic particle carrying member for carrying the magnetic particles by magnetic force; a stirring member, provided above the magnetic particle carrying member, for stirring the magnetic particles, the stirring member moving in the direction opposite from a movement direction of the magnetic particle carrying member at a position where the stirring member is opposed to the magnetic particle carrying member. The apparatus includes a magnetic brush, local anti-contamination feature.

10 Claims, 6 Drawing Sheets

CHARGING APPARATUS INCLUDING A MAGNETIC BRUSH WITH LOCAL ANTI-CONTAMINATION FEATURE

FIELD OF THE INVENTION AND RELATED ARTS

The present invention relates to a charging apparatus for charging an image bearing member used in an image forming apparatus, such as a copying machine or a printer, which employs an electrophotographic system, an electrostatic recording system, or the like. In particular, it relates to a charging apparatus which employs a magnetic brush based charging system.

An image forming apparatus such as a copying machine, a page printer, or the like, which employs an electrophotographic system, an electrostatic recording system, or the like, also employs a charging apparatus for charging (inclusive of removing electrical charge) a latent image bearing member, for example, an electrophotographic photosensitive member, an electrostatically recordable dielectric member, or the like, or objects different from a latent image bearing member. In the past a corona based charging device, which is a noncontact device, has been used as the above described charging apparatus for an image forming apparatus.

In recent years, a contact charging apparatus has been put to practical use, and has been replacing a corona based charging device. This is due to the fact that a contact charging apparatus is low in ozone production and power consumption, compared to a noncontact charging apparatus. There are various contact charging apparatuses; those which employ a roller based charging system, that is, those which employ an electrically conductive roller as a contact charging member, have been preferably used because of their stability in charging performance. In a roller based charging system, an electrically conductive, elastic roller as a contact charging member is directly pressed upon an object (hereinafter, "photosensitive member") which is to be charged, and the photosensitive member is charged by applying voltage to the roller.

However, even in the case of a contact charging apparatus, its fundamental charging mechanism is such that a photosensitive member is charged through electrical discharge from a contact charging member to the photosensitive member. Therefore, the value of the voltage applied to a contact charging member in order to charge a photosensitive member to a desired surface potential level must be greater than the value of the desired surface potential level. Also, ozone is generated although the amount is small. Further, when AC voltage is included as a component of the voltage applied to a contact charging member in order to improve the uniformity with which a photosensitive member is charged, unprecedented problems occur. For example, the amount by which ozone is generated increases; a contact charging member and a photosensitive member are caused to vibrate by the electrical field generated by the AC voltage, resulting in noises; and the rate at which the surface of a photosensitive member is deteriorated by electrical discharge is accelerated.

Thus, there has been desired a method for charging a photosensitive member by directly injecting electrical charge into the photosensitive member. U.S. Pat. No. 5,606,401 discloses such a charging method in which the peripheral surface of a photosensitive member is provided with a charge injection layer, and electrical charge is injected into this layer by a contact charging member. In this method, in other words, with the provision of a charge injection layer, a photosensitive member is sufficiently charged in a short time even if a contact charging member, the resistance value of which is no less than $1\times40^4$ Ω, is used as a contact charging member, making it possible to solve the above described problems of a contact charging system, that is, the problems traceable to electrical discharge, at their roots.

More specifically, a magnetic brush type charging member which comprises a magnetic brush portion formed by magnetically confining electrically conductive magnetic particle in the form of a brush is employed. In charging a photosensitive member, this magnetic brush portion is placed in contact with the photosensitive member. A magnetic type charging member is preferably used because it makes it possible to create a larger contact nip between the charging member and a photosensitive member, and also because it can be placed evenly in contact with the peripheral surface of a photosensitive member, in terms of a microscopic level, to prevent the photosensitive member from failing to be properly charged.

The magnetic brush portion of the above described magnetic brush type charging member is formed by magnetically confining particles of magnetic material (hereinafter, they may be referred to as "charge carrier"), on the surface of a magnetic particle bearing member. More specifically, magnetic particles, such as ferrite particles, the resistance value of which is in a range of $1\times10^4$–$1\times10^8$ Ω·cm, are magnetically confined in the form of a brush directly on a magnet, or on the peripheral surface of a sleeve in which the magnet is contained. In order to charge a photosensitive member, the magnetic brush type charging member is rotated, with its magnetic brush portion being placed in contact with the photosensitive member, and voltage is applied to the charging member.

One of the factors that affect the charging performance of a magnetic brush type charging apparatus which employs a magnetic brush, such as the one described above, as a contact charging member, is degree of uniformity with which the magnetic brush is placed in contact with the peripheral surface of a photosensitive member. In order to place the magnetic brush portion uniformly across the peripheral surface of a photosensitive member, a magnetic brush type charging apparatus is desired to be equipped with a regulating means for regulating the thickness of the magnetic brush, i.e., the layer of magnetic particles, on a magnetic particle bearing member, on the upstream side in terms of the rotational direction of the magnetic particle bearing member. With the provision of such a means, it is possible to accomplish uniformity in charging a photosensitive member. In other words, the provision of such a means makes it possible to provide a high degree of stability in charging a photosensitive member, and therefore, is preferable.

As for the material for the charge injection layer of a photosensitive member, compound material composed by dispersing microscopic electrically conductive particles in electrically insulative and transparent binder is preferably used. While the magnetic brush portion, to which voltage is being applied, is placed in contact with the charge injection layer, the electrically conductive particles behave as if they were numerous independent floating electrodes. As a result, numerous virtual condensers are formed by the electrically conductive substrate of the photosensitive member and these numerous floating electrodes, i.e., the electrically conductive particles, and electrical charge is taken up by these virtual condensers.

Therefore, the voltage applied to the contact charging member and the surface potential level of the photosensitive member converge to approximately the same value. In other words, the employment of a magnetic brush type charging member makes it possible to realize a low voltage charging method.

A charging method such as the one described above (method for charging an object by directly injecting electrical charge into the object) is called "charge injection". With the use of a charge injection apparatus (charge injection device), it is possible to realize a cleanerless image forming apparatus, that is, a transfer type image forming apparatus, which does not require a cleaner dedicated for cleaning the toner particles left on the image forming apparatus after image transfer.

b) Cleanerless System.

Next, a cleanerless system will be described. A cleanerless system is a cleaning system employed by a transfer type image forming apparatus which employs the so-called reversal developing system. In the reversal developing system, a photosensitive member is negatively charged, and a latent image is developed by adhering negatively charged toner to the exposed portions, that is, the portions with a reduced potential level.

In a cleanerless system, of the smaller amount of transfer residual toner particles, that is, toner particles remaining on a photosensitive member after image transfer, those with positive polarity are temporarily taken in by a charge injection apparatus. Then, they are charged to negative polarity in the charge injection apparatus, and then, are ejected back onto the photosensitive member from the charge injection apparatus. On the other hand, the transfer residual toner particles, the polarity of which remained negative, are mostly not taken in by the charge injection apparatus and are recovered, along with the transfer residual toner particles, which have been ejected from the charging injection apparatus, by a developing apparatus through a process for developing a latent image.

More specifically, the transfer residual toner particles are taken into a developing apparatus by the fog removal bias, that is, difference $V_{back}$ in potential level between the DC voltage applied to the developing apparatus, and the surface potential level of the photosensitive member, during a developing process.

According to this method, a portion of the transfer residual toner particles is recovered by the developing apparatus, by way of the charge injection apparatus, and the rest is directly recovered by the developing apparatus. After the recovery, they all are used in the following development processes. Therefore, no waste toner is generated, reducing the need for troublesome maintenance. Being cleanerless has merits in terms of space; the elimination of a cleaning apparatus drastically reduces the size of an image forming apparatus.

From the standpoint of the efficiency with which the transfer residual toner particles are recovered during a developing process, it is desired that an image forming apparatus employs a developing apparatus structured to place developer, for example, toner, or mixture of toner and carrier, in contact with a photosensitive member. In other words, it is desired that an image forming apparatus employs a developing apparatus which employs a contact developing system which uses single or two component developer.

However, a contact charging apparatus has its own problem. That is, in a contact charging apparatus, the contact charging member placed in contact with an object to be charged picks up the contaminants on the object to be charged, or other foreign matter, becoming substantially contaminated with the increase in accumulated usage, which results in decrease in charging performance. This is also true with a magnetic brush type charging apparatus.

Some image forming apparatuses with a magnetic brush type charging apparatus are provided with a cleaner dedicated for removing the transfer residual toner particles after image transfer. Even in the cases of such image forming apparatuses, toner particles or the like, tend to slip through the cleaner, although by only a small amount, and are carried to the position of the magnetic brush portion (charging nip) by the rotation of the photosensitive member, thus adhering to, or mixing into, the magnetic brush portion. Eventually, the transfer residual toner and the like, which passed through the cleaner, contaminate the magnetic brush portion, as an image formation cycle is repeated.

Normally, toner particles relatively high in electrical resistance are used as the toner particles for a developing apparatus. Therefore, as a relatively large amount of toner particles adheres to, or mixes into, the magnetic brush portion, in other words, as an excessive amount of toner particles accumulates around, or in, the magnetic brush portion, the electrical resistance of the magnetic brush type charging member, as a contact charging member, increases throughout the entirety, or some parts, of the charging member, resulting sometimes in a situation in which a photosensitive member fails to be charged to a desired potential level, and/or it is unevenly charged.

The above described type of contamination of a magnetic brush type charging member by toner particles, and resultant images of poor quality, are conspicuous, particularly, in the case of a cleanerless image forming apparatus, that is, an image forming apparatus which is not equipped with a cleaner dedicated for removing the transfer residual toner on a photosensitive member after image transfer.

More specifically, in the case of an image forming apparatus which employs a cleanerless system, a relatively large amount of the toner particles, which remains on a photosensitive member after image transfer, is carried, as it is, to the charging nip, in which it adheres, or mixed into, the magnetic brush portion on the magnetic brush bearing portion of a magnetic brush type charging member, tending to cause the magnetic brush type charging member to become excessively contaminated at a relatively early stage of its usage.

Further, in the case of a cleanerless system, the positively charged transfer residual toner particles on a photosensitive drum are temporarily taken into a charge injection device, in which their polarity is reversed. Thereafter, they are ejected back onto the photosensitive member. However, as a high density image is repeatedly and continuously formed across a particular area on a photosensitive member, the adhesion of toner particles tends to concentrate to the portion of the magnetic brush portion corresponding to this particular area on the photosensitive member. In other words, as a high density image is formed across a particular area on a photosensitive image for an extended length of time, the value of the electrical resistance of the magnetic brush portion increases, reducing the charging ability of the charging member, only across the portion of the magnetic brush portion corresponding to the area on the photosensitive member, across which the high density image is formed, whereas other portions of the magnetic brush portion retain a sufficient amount of charging ability. As a result, the photosensitive member is unevenly charged, which results in images irregular in density.

It may be assumed that if the charge carrier particles which form a magnetic brush shift or circulate in a charging apparatus, local contaminants of the magnetic brush are dispersed, being therefore diluted with the elapse of time. However, if the amount of the charge carrier placed in a charging apparatus scarcely exceeds the proper amount of the charge carrier to be borne on the peripheral surface of a sleeve, as a magnetic brush bearing member, to satisfactorily form a magnetic brush, the charge carrier hardly disperses in the longitudinal direction of the sleeve.

When the amount by which charge carrier is placed in the charging apparatus is increased so that a certain amount of charge carrier will remain in the charging apparatus after the charge carrier in the charging apparatus is borne on the peripheral surface of the sleeve by a proper amount, the charge carrier tends to slightly disperse with the elapse of time. However, the amount by which the charge carrier disperses in this case is not sufficient to eliminate the above described problem. This is due to the fact that charge carrier is very large in powder density, and therefore, hardly moves either straight or circulatorily within a charging apparatus.

Thus, an idea of providing a charging apparatus with a charge carrier stirring apparatus to circulate the charge carrier within the charging apparatus has been studied. However, it has been extremely difficult to effectively circulate charge carrier, since charge carrier is high in powder density as described above.

SUMMARY OF THE INVENTION

The primary object of the present invention is to provide a charging apparatus, the magnetic brush of which is prevented from being locally contaminated.

Another object of the present invention is to provide a charging apparatus which is excellent in the ability to circulate magnetic particles.

According to one of the aspects of the present invention, a charging apparatus comprises: magnetic particles which charge an object by being rubbed against the object; a particle bearing member which rotates while magnetically bearing the magnetic particles; and a stirring member disposed above said particle bearing member to stir the magnetic particles, wherein said stirring member moves in the direction opposite to the moving direction of said particle bearing member, in the area in which the distance between said stirring member and particle bearing member is smallest.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

(1) Image Forming Apparatus

Figure 1:
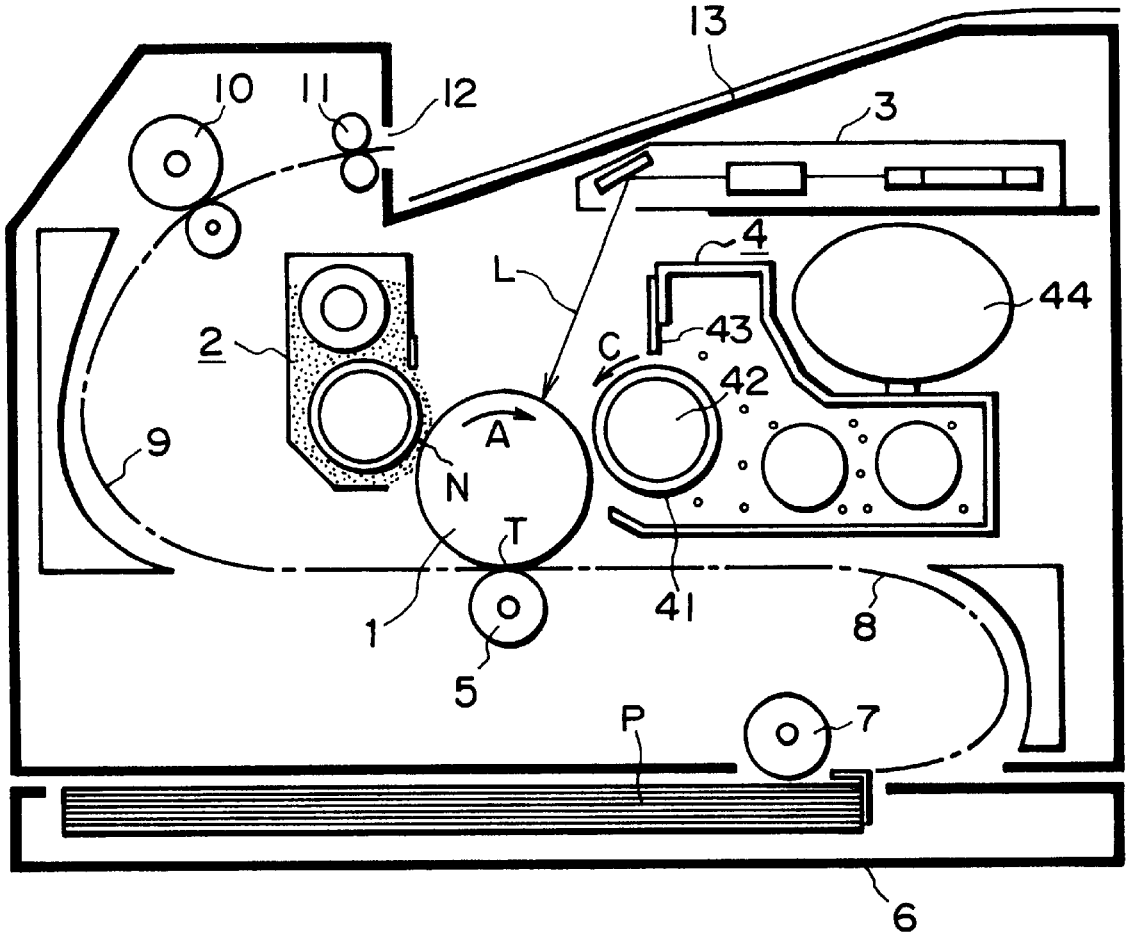
FIG. 1 is a schematic vertical sectional view of an image forming apparatus which employs the magnetic brush type charging apparatus in the first embodiment of the present invention.

FIG. 1 is a schematic sectional view of the image forming apparatus in this embodiment.

The image forming apparatus in this embodiment is a laser beam printer which employs a dry electrophotographic process, a charging injecting system, and a cleanerless cleaning process.

Designated by a referential code 1 is an electrophotographic photosensitive member in the form of a rotational drum (hereinafter, "photosensitive drum"). As the photosensitive drum 1 in this embodiment, any ordinary organic photosensitive member or the like may be employed. However, an organic photosensitive member which is provided with a surface layer ranging from $10^9$–$10^{14}$ Ω·cm in electrical resistance, a photosensitive member which uses amorphous silicone, or, the like, is preferable, because they can be charged by charge injection, which is effective to prevent ozone generation and also to reduce power consumption.

The photosensitive drum 1 in this embodiment is an organic photosensitive member which is charged to negative polarity. It comprises an aluminum drum as a base member which is 30 mm in diameter, a layer of ordinary photosensitive material coated on the peripheral surface of the aluminum drum, and a charge injection layer as a surface layer. It is rotationally driven in the clockwise direction indicated by an arrow mark A, at a predetermined process speed, that is 100 mm/sec in this embodiment.

The charge injection layer is a coated layer of a mixture of electrically insulative resin as binder, and microscopic particles of $SnO_2$ as electrically conductive microscopic particles dispersed in the binder. More specifically, it is a coated layer of compound material composed by dispersing microscopic particles (approximately 0.03 μm in diameter) of $SnO_2$ reduced in electrical resistance (made electrically conductive) by being doped with antimony, which is an electrically conductive and transparent filler, in resinous material by 70 wt. %. The thus composed material is coated to a thickness of approximately 3 μm by dipping, spraying, roller coating, beam coating, or the like, to form the charge injection layer.

A reference numeral 2 designates a contact charging apparatus for uniformly charging the peripheral surface of the photosensitive drum 1 to predetermined polarity and potential level. In this embodiment, the contact charging apparatus 2 is a magnetic brush type charging apparatus. As the photosensitive drum 1 is rotated, its peripheral surface is uniformly charged to approximately −700 V by the charge injection system employed by this magnetic brush type charging apparatus. The more specific structure of this magnetic brush type charging apparatus 2 will be described in detail in Section 2.

A reference numeral 3 designates an image information exposing means (exposing apparatus). In this embodiment, the exposing means 3 is a laser beam scanner which comprises a semiconductor laser, a polygon mirror, an F-θ lens, and the like. It projects a scanning laser beam L modulated with sequential, electric, and digital image signals in accordance with the image information of a target image. The sequential electric digital signals are inputted from an unillustrated host apparatus, for example, a reading apparatus with a photoelectric transducer such as a CCD, an electronic computer, a word processor, or the like. The uniformly charged peripheral surface of the rotating photosensitive drum 1 is exposed to the scanning laser beam. As a result, an electrostatic latent image in accordance with the image information of the target image is formed on the peripheral surface of the rotating photosensitive drum 1.

Designated by a reference numeral 4 is a developing apparatus, which develops an electrostatic latent image into a toner image, that is, a visible image, by placing two component developer in contact with the photosensitive drum 1. In this embodiment, an electrostatic latent image is reversely developed; in other words, toner is adhered to the exposed portions. The aforementioned two component developer comprises toner and carrier.

More specifically, the developing apparatus 4 is a magnetic brush type developing apparatus which uses two component developer. It comprises a development sleeve 41, a magnetic roller 42, and a developer regulating blade 43. The magnetic roller 42 is contained in the development sleeve 41. The developer, or a mixture of carrier and toner, is borne on the development sleeve 41. The developer regulating blade 43 is disposed adjacent to the development sleeve 41, with the provision of a predetermined amount of gap between the two components, so that as the development sleeve 41 is rotated in the direction indicated by an arrow mark C, a thin layer of developer is formed on the development sleeve 41. The development sleeve 41 is disposed with the provision of a predetermined amount of gap between the development sleeve 41 and photosensitive drum 1, so that the developer layer formed on the development sleeve 41 is placed in contact with the photosensitive drum 1 to develop a latent image during a development process.

The toner used in this embodiment is 6 $\mu$m in average particle diameter, and is negatively charged. As for the carrier for developer, magnetic carrier is used which is 205 emu/cm$^3$ in saturation magnetization and 35 $\mu$m in average particle diameter. The toner and carrier are mixed by a weight ratio of 6:94 to be used as developer. In order to keep constant the toner density within the developer, the toner density is detected by an unillustrated detecting means, so that toner is replenished from a toner hopper 44 as necessary.

To the development sleeve 41, DC voltage and AC voltage are applied from unillustrated power sources. In this embodiment, a DC voltage of −500 V, and an AC voltage which is 2,000 Hz in frequency and 1,500 V in peak-to-peak voltage, are applied to the development sleeve 41, to selectively adhere the toner to the exposed portions of the photosensitive drum 1 (reversal development).

A reference numeral 5 designates a transferring apparatus (transfer charger) disposed on the bottom side of the photosensitive drum 1. In this embodiment, the transfer charger 5 is of a transfer roller type.

Designated by a reference numeral 6 is a sheet feeder cassette, in which a plurality of sheets of transfer medium P as recording medium, such as paper, are stored in layers.

As a sheet feeder roller 7 is driven, the plurality of transfer medium P stored in layers in the sheet feeder cassette 6 are separated one by one and are delivered, with predetermined control timing, to a transfer station T, which is the compression nip between the rotating photosensitive drum 1 and transfer roller 5, through a sheet path 8 inclusive of conveyor rollers, a registration roller, and the like. After being delivered to the transfer station T, the transfer medium P is passed between the rotating photosensitive drum 1 and transfer roller 5, being pinched between the two. While the transfer medium P is passed through the transfer station T, predetermined transfer bias is applied to the transfer roller 5 from an illustrated transfer bias application power source, to change the transfer medium P to the polarity Opposite to the polarity of the toner, from the back side of the transfer medium P. As a result, the toner image on the rotating photosensitive drum 1 is electrostatically transferred onto the front side of the transfer medium P, in a continuous manner, starting from its leading end, while the transfer medium P is passed through the transfer station T.

After receiving a toner image while being passed through the transfer station T, the transfer medium P is separated, as if being peeled, from the peripheral surface of the rotating photosensitive drum 1, and is introduced into a fixing apparatus 10 (for example, a thermal roller type fixing apparatus) through a sheet path 9. In the fixing apparatus 10, the toner image on the transfer medium P is fixed to the transfer medium P. Thereafter, the transfer medium P is discharged into a delivery tray 13 by delivery rollers 11 through a delivery opening 12.

The printer in this embodiment is such a printer that employs a cleanerless cleaning process. In a cleanerless cleaning process, the transfer residual toner particles are delivered to the position of the magnetic brush type charging apparatus 2 by the rotation of the photosensitive drum 1. In this position, a certain portion (toner particles with positive electrical potential) of the transfer residual toner particles is temporarily taken into the magnetic brush portion of the magnetic brush type charging member, as a contact charging member, which is in contact with the photosensitive drum 1. After being taken into the charging apparatus 2, this portion of the transfer residual toner particles are charged to negative polarity, and then, are ejected back onto the photosensitive drum 1. Then, they are recovered by the developing apparatus 4 at the same time as a latent image on the photosensitive drum 1 is developed by the developing apparatus 4. The rest (transfer residual toner particles with positive electrical charge) of the transfer residual toner particles is allowed, as it is, to pass the position of the charging apparatus 2, and then, is recovered by the developing apparatus 4 at the same time as the latent image on the photosensitive drum 1 is developed by the developing apparatus 4. The photosensitive drum 1 is repeatedly subjected to the above described process to form images.

(2) Magnetic Brush Type Charging Apparatus 2

Figure 2:
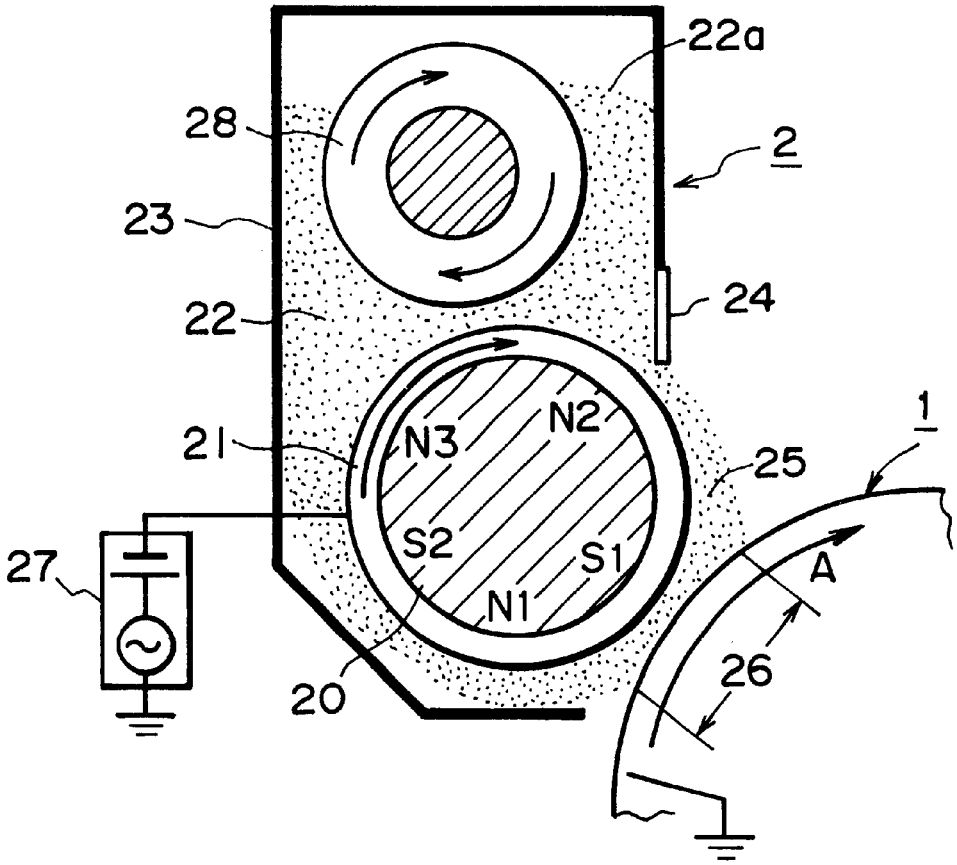
FIG. 2 is an enlarged schematic section of the magnetic brush type charging apparatus portion of the image forming apparatus in the first embodiment of the present invention.

FIG. 2 is an enlarged sectional view of the magnetic brush type charging apparatus portion of the image forming apparatus in FIG. 1.

This magnetic brush type charging apparatus 2 comprises a charge sleeve 21, a magnetic roller 20, and a magnetic brush portion 25. The charge sleeve 21 is a member for bearing the magnetic brush portico 25. The magnetic roller 20 is a means for generating a magnetic field and in contained in the charge sleeve 21. The magnetic brush portion is a layer of electrically conductive magnetic particles (charge carrier) confined in the form of a brush on the peripheral surface of the charge sleeve 21. The photosensitive drum 1 is charged to the predetermined potential level by the contact portion 26 (charge nip) which is between the photosensitive drum 1 and magnetic brush portion 25.

This magnetic brush type charging apparatus 2 plays a role in the cleanerless cleaning system. More specifically, it electrostatically recovers the transfer residual toner particles, in particular, those with positive electrical charge, from among the transfer residual toner particles brought into the charging nip portion 26 from the transfer station T. It also mechanically recovers the transfer residual toner particles other than those with the positive electrical charge by scraping the peripheral surface of the photosensitive drum 1 with the magnetic brush portion. Those transfer residual toner particles recovered by the magnetic brush type charging apparatus 2 are charged to the negative polarity within the apparatus 2 by the friction between the transfer residual toner particles and the charge carrier (magnetic particles).

A reference numeral 23 designates a container in which the above described charge sleeve 21 and charge carrier 22 are disposed, and a reference numeral 24 designates a regulating member (regulating blade) for regulating the amount of the charge carrier borne on the peripheral surface of the charge sleeve 21. A reference numeral 28 designates a rotational stirring member disposed adjacent to the topmost portion of the charge sleeve 21.

a) Charge Sleeve 21, Magnetic Roller 20, and Regulating Blade 24

The charge sleeve 21 is a nonmagnetic sleeve formed of aluminum, SUS, or the like. It is 16 mm in peripheral diameter and 220 mm in length. It is disposed at the opening of the container 23 for storing the charge carrier 22, in a manner to extend in the longitudinal direction of the opening, which also extends in the longitudinal direction of the container 23. With reference to the vertical plane inclusive of the rotational axis of the charge sleeve 21, approximately the left half of the cylindrical peripheral surface of the charge sleeve 21 is disposed within the container 23, and approximately the right half is exposed from the container 23. The peripheral surface of the charge sleeve 21 is provided with a proper degree of unevenness to effectively bear the charge carrier.

The magnetic roller 20 disposed within the charge sleeve 21 is provided with five magnetic poles: S1, S2, N1, N2 , and N3. It is nonrotationally fixed to the container 23, so that the magnetic pole S1 faces the charging nip portion 26, and the magnetic poles N2 and N3 which are the same in polarity, face upward.

The regulating blade 24 (magnetic brush layer regulating member) is in the form of a piece of plate, and is formed of nonmagnetic SUS. It is disposed so that a predetermined amount of gap is provided between the charge sleeve 21 and regulating blade 24. It regulates to a predetermined value, the amount of the charge carrier 22, which is held on the charge sleeve 21 by the magnetic field of the magnetic roller 20, and is conveyed in the clockwise direction indicated by an arrow mark, as the charge sleeve 21 is rotated, so that the magnetic brush portion 25 with a predetermined thickness is formed on the charge sleeve 21.

The charge sleeve 21 is disposed, with a predetermined amount of gap between the peripheral surfaces of the charge sleeve 21 and photosensitive drum 1, so that the charge nip portion 26 is formed at the contact portion between the magnetic brush portion 25 and photosensitive drum 1. The contact nip portion 26 affects how the photosensitive drum 1 is charged. In this embodiment, the aforementioned predetermined amount of gap Is sat so that the width of the charge nip portion 26 becomes 6 mm.

The charge sleeve 21 is rotationally driven by an unillustrated motor, in the clockwise direction indicated by an arrow mark, so that the peripheral surfaces of the charge sleeve 21, and photosensitive drum 1, that is, an object to be charged, rotate in the directions opposite to each other at their virtual interface 26 (charge nip portion. In this embodiment, in comparison to the rotational speed of 100 mm/sec for the photosensitive drum 1, the charge sleeve 21 is rotated at 150 mm/sec in the counter direction relative to the photo sensitive drum 1. Increasing the rotational speed of the charge sleeve 21 increases the frequency at which the peripheral surface of the photosensitive drum 1 makes contact with the magnetic brush portion 25, improving thereby the stability in charging the photosensitive drum 1, as well an the efficiency with which the transfer residual toner particles on the photosensitive drum 1 are taken in by the magnetic brush portion 25.

To the magnetic brush portion 25, a predetermined charge bias is applied from a charge bias power source 27 through the charge sleeve 21, so that the peripheral surface of the photosensitive drum 1, which is the object to be charged, is charged to the predetermined polarity and potential level, in the charge nip portion 26, through the contact charging process. The bias applied in this embodiment is a compound bias comprising a DC voltage of −700 V, and an AC voltage which is rectangular in waveform, 800 V in peak-to-peak voltage, and 1,000 Hz in frequency.

b) Charge Carrier 22

As the charge carrier 22, it is possible to use magnetic metallic particles, for example, ferrite particles, magnetite Particles, or the like. It is also possible to use particles formed by binding these electrically conductive carrier particles with the use of resin. The charge carrier 22 Is desired to be in a range of 10–100 $\mu$m in average particle diameter, in a range of 20–250 emu/cm$^3$ in saturation magnetization, and in a range of $1\times10^2$–$1\times10^{10}$ Ω·cm in electrical resistance. In consideration of the fact that the photosensitive drum 1 might have insulative defects such an a pinhole, the charge carrier 22 is desired to be high in electrical resistance. However, in consideration of charging efficiency, charge carrier which is low in electrical resistance in preferable. In this embodiment, a charge carrier which is 25 $\mu$m in average particle diameter, 200 emu/cm$^3$ in saturation magnetization, and $5\times10^6$ Ω·cm in electrical resistance, is used.

This charge carrier 22 is placed in the container 23 by 150 g, so that the magnetic brush portion 25 is formed on the peripheral surface of the charge sleeve 21. In this embodiment, the amount of the charge carrier borne on the peripheral surface of the charge sleeve 21 is 6.8 g per one centimeter in the longitudinal direction of the charge sleeve 21. The portion of the charge carrier, which did not form the magnetic brush portion 25, remains piled above the charge sleeve 21, in the container 23. In the space in which the charge carrier remains piled, the stirring member 28 is disposed.

c) Stirring Member 28

The stirring member 28 is rotationally supported between the longitudinal end walls of the container 23 with the use of bearings, approximately parallel to and above the charge sleeve 21.

Figure 3:
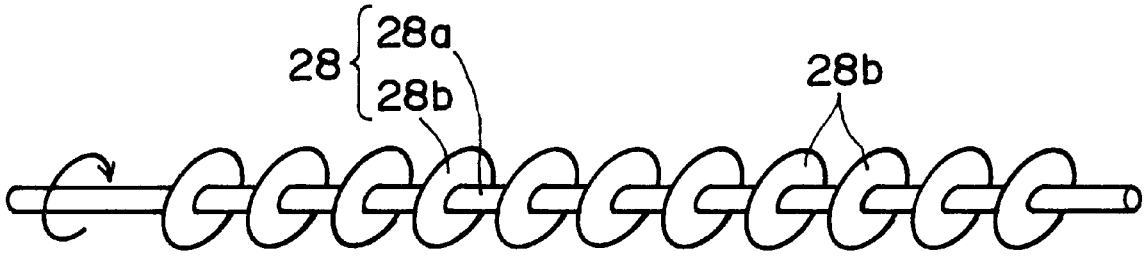
FIG. 3 is a schematic drawing of a stirring member.

The stirring member 28 comprises a rotational shaft **28*a*, and a plurality of slanted oval rings 28*b*, through the center hole of which the rotational shaft 28*a*is put through as shown in FIG. 3. The rings 28*b* are not in contact with the peripheral surface of the charge sleeve 21. They are disposed so that they invade into the portion of the charge carrier 22, which is shortly going to be borne on the charge sleeve 21 as the charge sleeve 21 is rotated in the area in which the distance between the oval rings 28*b* and the peripheral surface of the charge sleeve 21 is smallest. The smallest distance between these oval rings 28***b* and the peripheral surface of the charge sleeve 21 is desired to be in a range of 0.5–4 mm. Placing the oval rings 28*b* in contact with the peripheral surface of the charge sleeve 21 is not desirable, because, if the oval rings 28*b* are placed in contact with the peripheral surface of the charge sleeve 21, the load which applies to the peripheral surface of the charge sleeve 21 increases, causing such a problem as the shaving of the peripheral surface of the charge sleeve 21. Further, when they are not placed in contact with the peripheral surface of the charge sleeve 21, the aforementioned distance should not be excessively small, because, if the distance between the oval rings 28*b* and the peripheral surface of the charge sleeve 21 is extremely small, the load which applies to the charge carrier 22 and charge sleeve 21 increases, resulting in an increase in the torque required to drive the charge sleeve 21. Obviously, if the distance is very large, the stirring member 28 fails to effectively stir the charge carrier 22. Therefore, it is not desirable that the distance be excessively large. In this embodiment, the charging apparatus 2 is structured so that the distance between the rings 28*b* and the peripheral surface of the charge sleeve 21, at the point where the distance between the rings 28*b* and the peripheral surface of the charge sleeve 21 is smallest, becomes 1 mm.

Further, the stirring member 28 is disposed on the top side of the charge sleeve 21 so that the point at which the distance between the stirring member 28 and charge sleeve 21 is smallest coincides with a point within the area between the two magnetic poles N2 and N3, which are the same in polarity, and are an the top side of the magnetic roller 20, as a magnetic field generating means, nonrotationally and fixedly disposed within the charge sleeve 21.

The rotational direction of the stirring member 28 Is such that, as the stirring member 28 is rotated, the charge carrier 22 is peeled away from the peripheral surface of the charge sleeve 21. In other words, the rotational direction is the clockwise direction, indicated by an arrow mark, which is the same as the rotational direction of the charge sleeve 21.

In this embodiment, the aforementioned rings 28*b* are attached to the rotational shaft 28*a* with a diameter of 4 mm, with equal intervals, at an angle of 45 degrees, so that their rotational diameters become 14 mm. The stirring member 28 is rotated at 30% of the revolution of the charge sleeve 21.

With the provision of the above described structure, the charge carrier is temporarily separated from the charge sleeve 21 by the repulsive magnetic field generated by the magnetic poles N2 and N3 which are the same in polarity and am parallelly disposed side by side. After being separated from the charge sleeve 21, the charge carrier 22 in caught by the stirring member 28, being thereby thoroughly stirred and dispersed. Without the provision of the repulsive magnetic field portion, it sometimes occurs that the charge carrier particles which are very close to the peripheral surface of the charge sleeve 21 follow, undisturbed, the rotation of the charge sleeve 21, failing to be caught by the stirring member 28. On the other band, with the provision of the structure with the repulsive magnetic field portion, all magnetic carrier particles are temporarily separated from the charge sleeve 21 by the repulsive magnetic field portion. Therefore, there are almost no charge carrier particles which follow, undisturbed the rotation of the charge sleeve 21, and fall to be caught by the stirring member 28. Consequently, the charge carrier 22 is very desirably stirred.

Further, the stirring member 28 is disposed approximately directly above the charge sleeve 21. Therefore, the charge carrier 22 in quite naturally supplied from the stirring member 28 to the charge sleeve 21 by a combination of gravity, and the magnetic force from the magnetic pole N3.

In other words, according to the present invention, a desirable circulatory path for the charge carrier is formed, through which the charge carrier on the charge sleeve 21 is temporarily separated from the charge sleeve 21 by the repulsive magnetic field, is delivered to the stirring member 28, is sufficiently stirred, and is supplied back onto the charge sleeve 21.

The positional relationship between the stirring member and magnetic poles needs to be such that the position of the point at which the distance between the stirring member 26 and charge sleeve 21 is smallest coincides with the position of a point between the magnetic poles N2 and N3 which are the same in polarity. If the stirring member 28 is positioned outside the range between the magnetic poles N2 and N3, it is impossible to establish the aforementioned desirable charge carrier transfer path, through which the charge carrier smoothly flows; in other words, the provision of the magnet with five magnetic poles become meaningless. Preferably, the structure of the charging apparatus 2 is such that the axial line of the stirring member 28 is in a range, which is directly above the charge sleeve 21, and the width of which is equal to the external diameter of the charge sleeve 21.

The function of the stirring member 28 is to disperse and move the charge carrier in the longitudinal direction of the charge sleeve. A simple stirring member, such as a stirring rod, can also provide a certain amount of dispersing effect similar to that of the stirring member 28 in this embodiment. However, when a stirring member, such as the one employed in this embodiment, which comprises a shaft 28*a*, and a plurality of oval rings 28*b* attached to the shaft 28*a*, is employed, the charge carrier is shaken in short strokes in the longitudinal direction of the charge sleeve as it enters the intervals of the rings 28*b* as the stirring member 28 is rotationally driven. Therefore, the charge carrier disperses better in the longitudinal direction of the charge sleeve.

The amount of the charge carrier within the container 23 in desired to be such that the top surface 22*a* (simply, "surface") of the charge carrier 22 is at, or above, the level of the rotational axis the stirring mew or 28, and at, or below, the level of the highest point to which the stirring member 28 reaches if the charge carrier surface 22*a* falls below the level of the rotational axis of the stirring member 26, the stirring effect of the stirring member fails to be sufficiently realized. On the contrary, if the charge carrier surface 22*a* rises above the level of the highest point to which the stirring member 28 reaches, the amount of the charge carrier in the area to which the stirring member does not reach increases. Therefore, it is not desired that the charge carrier surface 22*a* is at or below the level of the highest point to which the stirring member reaches, because the charge carrier within the area to which the stirring member does not reach hardly moves.

As the charge carrier is moved into the space outside the immediate adjacencies of the charge sleeve 21, and the rotational range of the stirring member 28, the charge carrier virtually stops moving. Therefore, it is meaningless to provide the container 23 with an internal space larger than necessary; the charging apparatus is desired to be constructed so that the container 23 is provided with as small an internal space as possible in which the proper amount of, the charge carrier 22 for keeping the charge carrier surface 22*a* at the aforementioned correct level can be stored.

(3) Comparative Example

Figure 4:
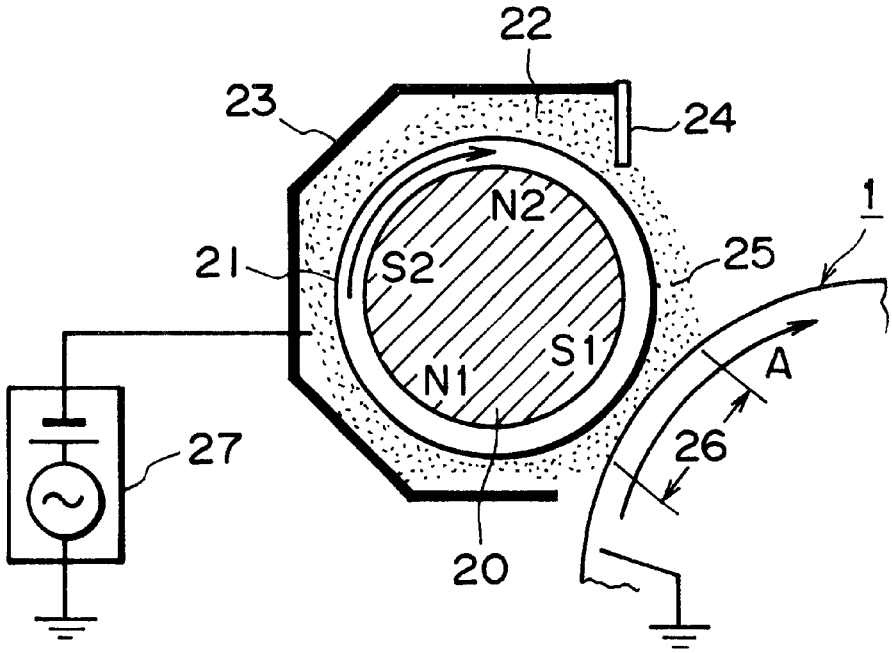
FIG. 4 is a schematic section of the magnetic brush type charging apparatus (with no stirring member) in the comparative example.
Figure 5:
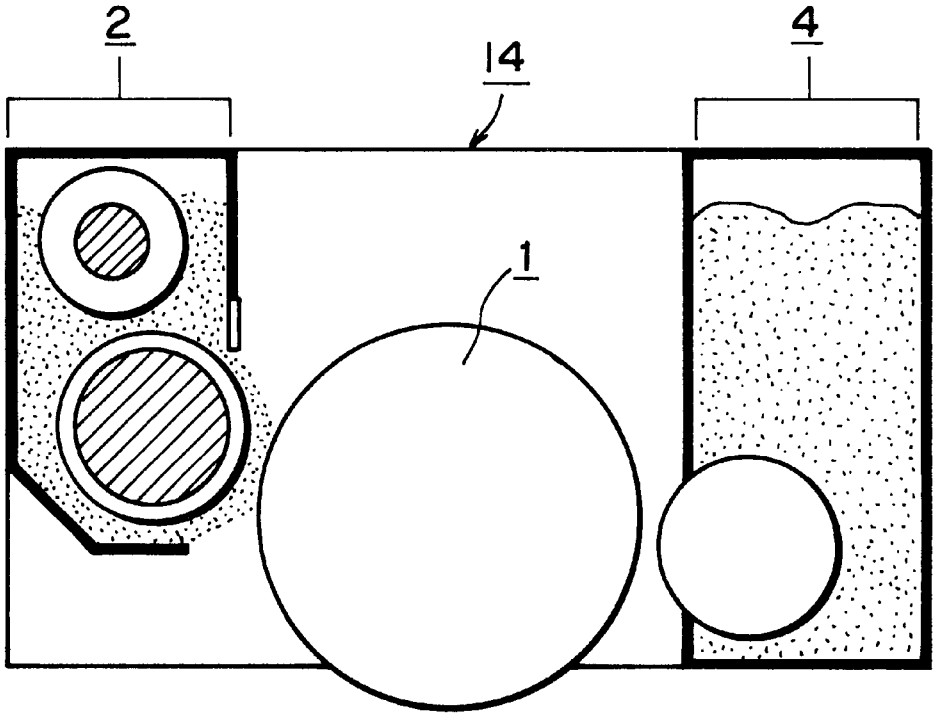
FIG. 5 is a schematic section of the process cartridge in the second embodiment of the present invention.

FIG. 4 shows an example of a charging apparatus which is not provided with a stirring member. The magnetic roller 20 in this charging apparatus is provided with only four magnetic poles. The amount of the charge carrier placed in the container 23 is only 50 g which is just enough to sufficiently cover the peripheral surface of the charge sleeve 21 once. In this case, the proper amount of charge carrier to be borne on the charge sleeve 21 per 1 cm in terms of the longitudinal direction of the charge sleeve 21 is 2 g. The other structural features are the same as those of the apparatus in FIG. 2.

As described above, the aforementioned 50 g of charge carrier stared in the container 23 is approximately the same amount of charge carrier by which the peripheral surface of the charge sleeve 21 can be satisfactorily covered once. Therefore, the charge carrier particles of the magnetic brush portion 25 on the charge sleeve 12 hardly switch places among them, being borne undisturbed by the rotating charge sleeve 21. In other words, they hardly disperse in the longitudinal direction of the charge sleeve 21.

Embodiment 2

This embodiment regards a process cartridge removably installable in the main assembly of an image forming apparatus. FIG. 15 is a schematic view of the process cartridge 14 in this embodiment, and shows the general structure thereof. The process cartridge 14 comprises three processing devices for image formation: a photosensitive drum 1 as a latent image bearing member, a charging apparatus 2 for charging the photosensitive drum 1, and a developing apparatus 4. In other words, these processing devices are integrally combined in the form of a process cartridge so that they can be removably installable in the main assembly of an illustrated image forming apparatus. As the charging apparatus 2, a charging apparatus with the same structure as that of the charging apparatus in the first embodiment 1 is used.

With the provision of the above described structural arrangement, not only are the same effects as those in the first embodiment accomplished, but also these structural components can be replaced in a single step, drastically improving the efficiency in maintenance. Further, since the components which are essential in electrophotography can be replaced with new components all at once, it is possible to always keep image quality at a high level.

A process cartridge is a cartridge in which a charging means, a developing means, or a cleaning means, and an image bearing member, are integrally placed, and which is removably installable in the main assembly of an image forming apparatus; a cartridge in which at least one means among a charging means, a developing means, and a cleaning means, and an image bearing member, are integrally placed, and which is removably installable in the main assembly of an image forming apparatus; or a cartridge in which at least a charging means or a developing apparatus and an image bearing member, are integrally placed, and which is removably installable in the main assembly of an image forming apparatus.

Embodiment 3

Figure 6:
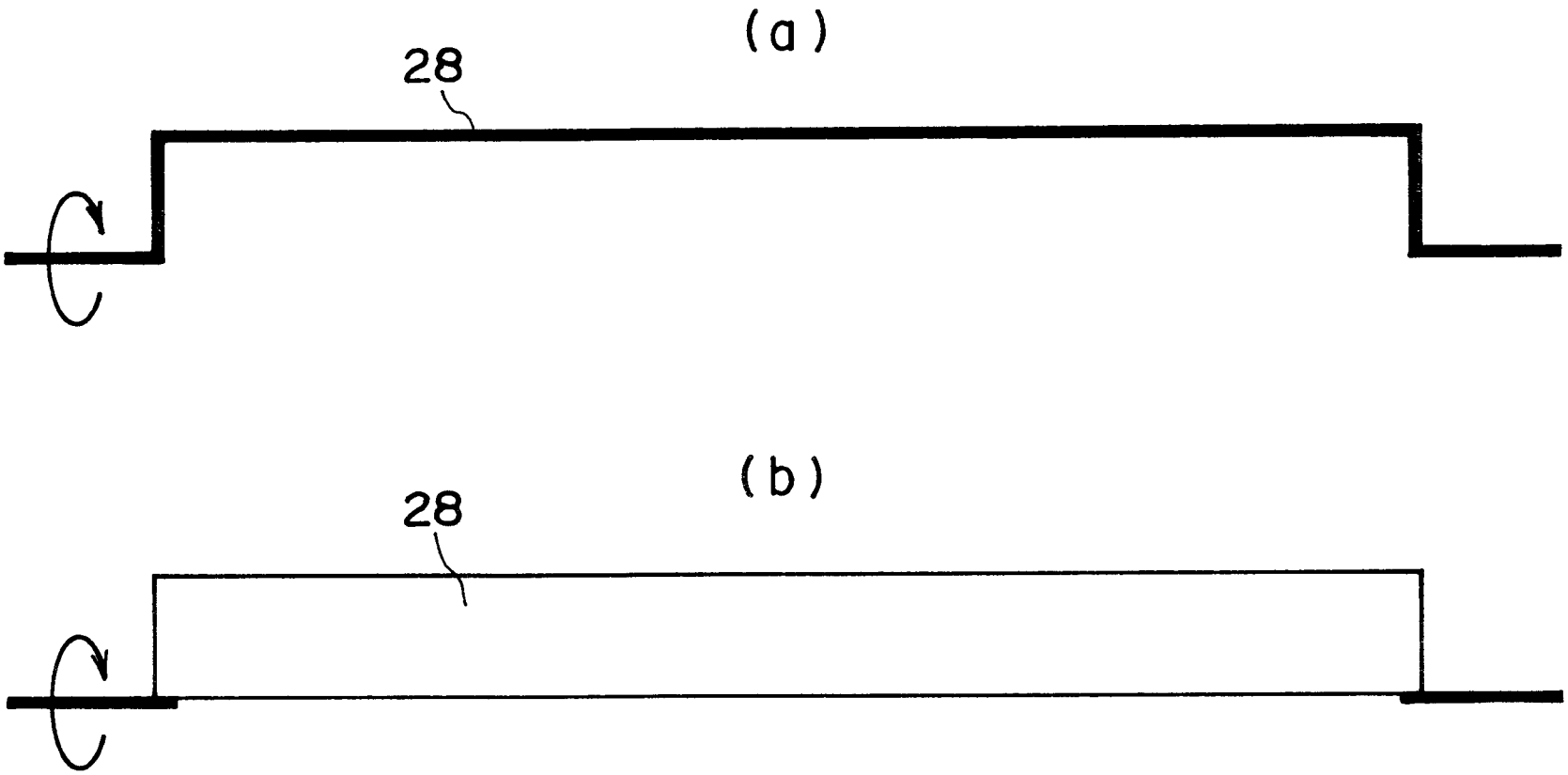
FIGS. 6(*a*) and 6(*b*) are schematic drawings which show stirring member structures different from the structure the stirring member depicted in FIG. 3.

This embodiment relates to various components inclusive of process cartridges themselves employed in the first and second embodiments. The structure of a stirring member may be simplified according to the effects to be accomplished. For example, the stirring member 28 in the preceding embodiments which comprised the oval rings may be replaced with a stirring member of a simple form, such as the stirring members 28 illustrated in FIGS. 6, (*a*) and (*b*), which are formed by bending a piece of metallic wire in the form of a crank.

Embodiment 4

Figure 7:
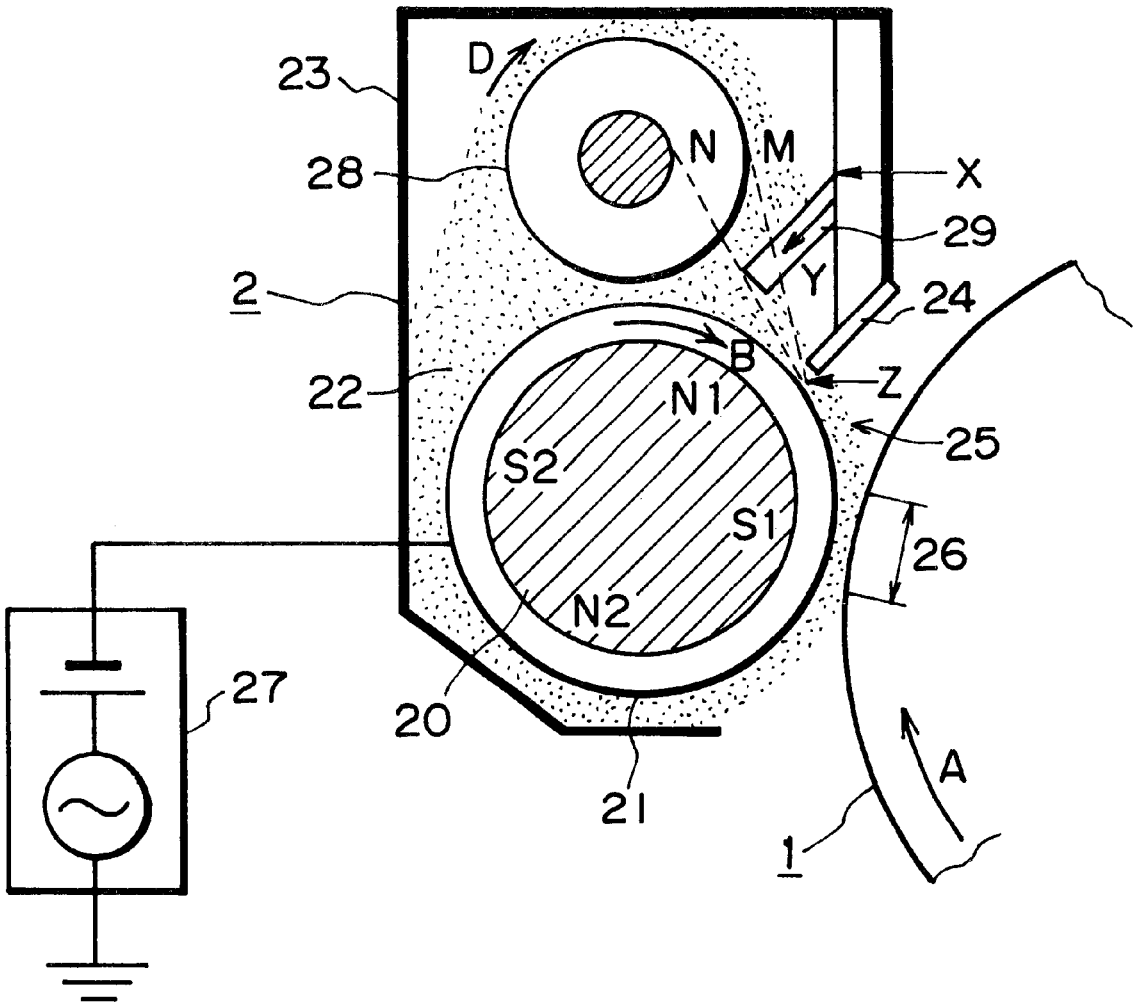
FIG. 7 is a schematic vertical section view of the charging apparatus in the fourth embodiment of the present invention.

FIG. 7 is a schematic sectional view of the charging apparatus in the fourth embodiment of the present invention.

In this magnetic brush type charging apparatus 2, a magnetic brush portion 25 is formed of magnetic particles 22, an the peripheral surface of a charge sleeve 21 (magnetic carrier bearing member) which contains a magnetic roller 20 (magnetic field generating means). This magnetic brush type charging apparatus 2 charges a photosensitive drum 1 to a predetermined potential level at the contact portion 26 (charge nip portion) between the photosensitive drum 1 and magnetic brush portion 25.

Further, this magnetic brush type charging apparatus 2 plays a role in the cleanerless cleaning system. More specifically, it electrostatically recovers the transfer residual toner particles, in particular, those with positive electrical charge, from among the transfer residual toner particles brought into the charging nip portion 26 from the transfer station T. It also mechanically recovers the transfer residual toner particles other than those with the positive electrical charge, by scraping the peripheral surface of the photosensitive drum 1 with the magnetic brush portion. Those transfer residual toner particles recovered by the magnetic brush type charging apparatus 2 are charged to the negative polarity within the apparatus 2 by the friction between the transfer residual toner particles and the magnetic particles 22 in the apparatus 2, and then, are ejected onto the photosensitive drum 1.

a) Charge Sleeve 21, Magnetic Roller 20, and Regulating Blade 24

The charge sleeve 21 is a nonmagnetic sleeve formed of aluminum, SUS, or the like. It is disposed at the opening of the container 23 for storing the charge carrier 22, in a manner to extend in the longitudinal direction of the opening, which extends in the longitudinal direction of the container 23. With reference to the vertical plane inclusive of the rotational axis of the charge sleeve 21, approximately the left halt of the cylindrical peripheral surface of the charge sleeve 21 is disposed within the container 22, and approximately the right half is exposed from the container 23. The peripheral surface of the charge sleeve 21 is provided with a proper degree of unevenness to effectively beer the charge carrier.

The magnetic roller 20 disposed within the charge sleeve 21 has been magnetized to provide the magnetic roller 20 with four magnetic poles, so that the peak density of the magnetic flux from the magnetic roller 20 in the radial direction of the magnetic roller 20 becomes approximately 800 gauss at the peripheral surface of the charge sleeve 21. In order to prevent the magnetic particles 22 from remaining adhered to the photosensitive drum 1, and being conveyed forward by the rotation of the photosensitive drum 1, the magnetic roller 20 is fixed to the container 23 so that one of the magnetic poles, more specifically, the magnetic pole S1, faces the charge nip portion 26.

The regulating blade 24 (magnetic brush layer regulating member) is in the form of a piece of plate, and is formed of nonmagnetic SUS. It is disposed so that a predetermined amount of gap is provided between the charge sleeve 21 and regulating blade 24. It regulates to a predetermined value, the amount of the charge carrier 22, which is held on the charge sleeve 21 by the magnetic field of the magnetic roller 20, and is conveyed in the clockwise direction indicated by an arrow mark B, as the charge sleeve 21 is rotated, so that the magnetic brush portion 25 with a predetermined thickness is formed on the charge sleeve 21.

The charge sleeve 21 is disposed, with a predetermined amount of gap between the peripheral surfaces or the charge sleeve 21 and photosensitive drum 1, so that the charge nip portion 26 is formed at the contact portion between the magnetic brush portion 25 and Photosensitive drum 1. The contact nip portion 26 affects how the photosensitive drum 1 is charged. In this embodiment, the aforementioned predetermined amount of gap in set so that the width of the charge nip portion 26 becomes 6 mm.

The charge sleeve 21 is rotationally driven by an illustrated motor, in the clockwise direction indicated by an arrow mark B, so that the peripheral surfaces of the charge sleeve 21, and photosensitive drum 1, that is, an object to be charged, rotate in the directions opposite to each other at their virtual interface 26 (charge nip portion). In this embodiment, in comparison to the rotational speed of 100 mm/sec for the photosensitive drum 1, the charge sleeve 21 is rotated at 150 mm/sec in the counter direction relative to the photosensitive drum 1. Increasing the rotational speed of the charge sleeve 21

The charge sleeve 21 is rotationally driven by an unillustrated motor, in the clockwise direction indicated by an arrow mark B, so that the peripheral surfaces of the charge sleeve 21, and photosensitive drum 1, that is, an object to be charged, rotate in the directions opposite to each other at their virtual interface 26 (charge nip portion). In this embodiment, in comparison to the rotational speed of 100 mm/sec for the photosensitive drum 1, the charge sleeve 21 is rotated at 150 mm/sec in the counter direction relative to the photosensitive drum 1. Increasing the rotational speed of the charge sleeve 21 increases the frequency at which the peripheral surface of the photosensitive drum 1 makes contact with the magnetic brush portion 25, thereby improving the stability in charging the photosensitive drum 1, as well as the efficiency with which the transfer residual toner particles on the photosensitive drum 1 are taken in by the magnetic brush portion 25.

To the magnetic brush portion 25, a predetermined charge bias is applied from a charge bias power source 27 through the charge sleeve 21, so that the peripheral surface of the photosensitive drum 1, which is the object to be charged, is charged to the predetermined polarity and potential level, in the charge nip portion 26, through the contact charging process. The bias applied in this embodiment is a compound bias comprising a DC voltage of −700 V, and an AC voltage which is rectangular in waveform, 800 V in peak-to-peak voltage, and 1,000 Hz in frequency.

b) Charge Carrier 22

As for the electrically conductive charge carrier 22, it is possible to use magnetic metallic particles, for example, ferrite particles, magnetite particles, or the like. It is also possible to use the particles formed by binding these electrically conductive carrier particles with the use of resin. In consideration of the fact that the photosensitive drum 1 might have insulative defects such as a pinhole, the charge carrier 22 is desired to be higher in electrical resistance value than a certain level. More specifically, the desired magnetic metallic particles are those, the electrical resistance values of which are in a range of $1\times10^{6}$–$1\times10^{10}$ Ω·cm. In terms of particle diameter, the charge carrier 22 is desired to be in a range of 10–50 μm, preferably, in a range of 20–40 μm in consideration of the adhesion of the electrically conductive magnetic particles to a photosensitive member, and the uniformity with which the photosensitive drum 1 is charged. It is possible to use as the charge carrier 22, a mixture of different types of electrically conductive magnetic particles, to improve the efficiency with which the photosensitive drum 1 is charged. In terms of saturation magnetism, the charge carrier 22 is desired to be in a range of 20–250 emu/cm$^3$. In this embodiment, charge carrier which is $5\times10^{6}$ Ω·cm in electrical resistance, 25 μm in average particle diameter, and 200 emu/cm$^3$ in saturation magnetization, is used.

c) Stirring Member 28

The stirring member 28 is rotationally supported between the longitudinal end walls of the container 23 with the use of bearings, approximately parallel to and above the charge sleeve 21.

The stirring member 28 comprises a rotational shaft 28*a*, and a plurality of slanted oval rings 28*b* through the center hole of which the rotational shaft 28*a* is put through as shown in FIG. 3. The rings 28*b* are not in contact with the peripheral surface of the charge sleeve 21. They are disposed so that they invade into the portion of the charge carrier 22, which is shortly going to be borne on the charge sleeve 21 as the charge sleeve 21 is rotated, in the area in which the distance between them and the peripheral surface of the charge sleeve 21 is smallest. This smallest distance between these oval rings 28*b* and the peripheral surface of the charge sleeve 21 is desired to be in a range of 0.5–4 mm. Placing the oval rings 28*b* in contact with the peripheral surface of the charge sleeve 21 is not desirable, because, if the oval rings 28*b* are placed in contact with the peripheral surface of the charge sleeve 21, the load which applies to the peripheral surface of the charge sleeve 21 increases, causing such a problem as the shaving of the peripheral surface of the charge sleeve 21. Further, when they are not placed in contact with the peripheral surface of the charge sleeve 21, the aforementioned distance should not be excessively small, because, if the distance between the oval rings 28*b* and the peripheral surface of the charge sleeve 21 is extremely small, the load which applies to the charge carrier 22 and charge sleeve 21 increases, resulting in increase in the torque required to drive the charge sleeve 21. Obviously, if the distance is very large, the stirring member 28 fails to effectively stir the charge carrier 22. In this embodiment, the charging apparatus 2 is structured so that the distance between the rings 28*b* and the peripheral surface of the charge sleeve 21, at the point where the distance between the rings 28*b* and the peripheral surface of the charge sleeve 21 is smallest, becomes 1 mm.

The rotational direction of the stirring member 28 is such that, as the stirring member 28 is rotated, the charge carrier 22 is peeled away from the peripheral surface of the charge sleeve 21. In other words, it is the clockwise direction, indicated by an arrow mark D, which is the same as the rotational direction of the charge sleeve 21.

In this embodiment, the aforementioned rings 28*b* are attached to the rotational shaft 28*a* with a diameter of 4 mm, with equal intervals, at an angle of 45 degrees, so that their rotational diameters become 14 mm. The stirring member 28 is rotated at 30% of the revolution of the charge sleeve 21.

The strength with which the magnetic roller 20 confines the magnetic particles 22 is the greatest right above the magnetic poles of the magnetic roller 20. Therefore, in terms of the efficiency with which the magnetic particles 22 are stirred, and in order to reduce the aforementioned torque, the point at which the distance between the stirring member 28 and charge sleeve 21 is smallest is desired to be between the adjacent two magnetic poles of the magnet 20. In this embodiment, the charging apparatus 2 is structured so that the point at which the distance between the rings 28*b* and charge sleeve 21 is smallest is positioned between the two magnetic poles N1 and N2 of the magnet 20.

As this stirring member 28 is rotated in the direction indicated by an arrow mark D, it stirs those magnetic particles 22 which have been sent to the adjacencies of the stirring member 28 supported above the charge sleeve 21, in the rotational direction of charge sleeve 21, as well as in the longitudinal direction of the charge sleeve 21. In other words, the stirring member 28 circulates those magnetic particles in the direction to peel them away from the charge sleeve 21, with the front surfaces, in terms of the rotational direction of the charge sleeve 21, of the slantly mounted rings 28*b*, the peripheral edges of the slantly mounted rings 28*b*, and the surface of the rotational central shaft 28*a*. Also, the stirring member 28 stirs the magnetic particles 22 in the longitudinal direction of the charge sleeve 21; more specifically, as the magnetic particles 22 enter between the adjacent two rings 28*b*, both the front and back surfaces of each ring 28*b* apply force to those magnetic particles 22 in the longitudinal direction of the charge sleeve 21 so that those magnetic particles 22 shuttle in the longitudinal direction of the charge sleeve 21. Those magnetic particles 22 which have been lifted by the rotation of the stirring member 28 are sent back toward the charge sleeve 21 by the conveying ability of the stirring member 28, and the effect of gravity.

d) Shielding Member 29

A shielding member 29 is disposed next to the stirring member 28 in the horizontal direction. It prevents the magnetic particles 22 from being directly sent to a regulating portion Z, that is, the area in which the distance between the regulating blade 24 and charge sleeve 21 is smallest, as the magnetic particles 22 are conveyed toward the charge sleeve 21 by the stirring member. In order to prevent the magnetic particles 22 from settling on the top surface of the shielding member 29, the shield member 29 is tilted downward so that the angle of its top surface relative to the horizontal direction becomes 45 degrees.

In order to examine the effects of this shielding member 29 upon the unsatisfactory coating of the magnetic particles 22 on the peripheral surface of the charge sleeve 21, the inventors of the present invention carried out an experiment in which the shielding members 29 in the form of a piece of plate were used. More specifically, a plurality of the shielding members which were 0 mm, 3 mm, 5 mm, 7 mm, and 9 mm, in the length in the direction of an arrow mark Y from a point X at which they are attached to the wall of the container illustrated in FIG. 7 were employed to examine the aforementioned effects. The results are shown in Table 1.

TABLE 1

| Length | Coat quality |
|---|---|
| 0 mm | N |
| 3 mm | F |
| 5 mm | G |
| 7 mm | G |
| 9 mm | E |

E: no bad-coating occurred
G: bad-coating scarcely occurs

TABLE 1-continued

| Length | Coat quality |
|---|---|

F: a few bad-coating occurs
N: bad-coating always occurs

1) When the length of the shielding member 29 was 0 mm, that is, when the shielding member 29 was not provided, the most seriously defective coats were formed. More specifically, some portions of the charge sleeve 21 completely failed to be coated by the magnetic particles 22, in both the longitudinal and circumferential directions.

2) When the shielding member 29 with a length of 3 mm was employed, some portions of the charge sleeve 21 completely failed to be satisfactorily coated by the magnetic particles 22, although the coat quality was slightly better in comparison to when the length of the shielding member 29 was 0 mm. In other words, the shielding member 29 was not fully effective.

3) When the shielding members 29 with lengths 5 mm and 7 mm, respectively, were employed, the unsatisfactory coating scarcely occurred; reasonably good results could be obtained.

4) When the shielding member 29 with a length of 9 mm was employed, the unsatisfactory coating did not occur at all.

Based on these results, the factors which affected the unsatisfactory coating were investigated, and the following was discovered. That is, the most essential factor that affected the quality of the coating was the position of the operative edge of the shielding member 29 relative to the stirring member 28 and regulating portion Z.

More specifically, referring to FIG. 7, when the shielding member 29 which was 5 mm in the aforementioned dimension was used, its operative edge reached the straight line (dotted line M in FIG. 7) which was in contact with the tip of the regulating portion Z, and was tangential to the circle drawn by the intersection of the major axis and peripheral edge of the ring 28*b*. When the shielding member 29 which was 9 mm in the aforementioned dimension was used, it intersected with the line M, and its operative edge reached the straight line (dotted line N in FIG. 7) which was in contact with the tip of the regulating portion Z, and was tangential to the peripheral surface of the rotational shaft 28*a* of the stirring member 28.

In other words, as the shielding member 29 was large enough in the aforementioned dimension to reach or intersect with the straight line, which was in contact with the tip of the regulating portion Z, and was tangential to the circumference of the projected image of the stirring member in FIG. 7, those magnetic particles 22, which were conveyed toward the regulating portion Z from the adjacencies of the aforementioned circumference of the projected image of the stirring member 28, that is, those magnetic particles 22 which were most likely to be unevenly conveyed by the stirring member 28, were prevented from moving straight to the regulating portion Z, so that the charge sleeve 21 were prevented from being unsatisfactorily coated with the magnetic particles 22.

Further, the shielding member 29 was more effective when it was positioned so that it reached the aforementioned straight line, which was in contact with the tip of the regulating portion Z, and was tangential to the peripheral surface of the rotational shaft of the stirring member 28. In other words, the shielding member 29 was more effective when it was positioned so that the shielding member 29 shielded the regulating portion Z from the entirety of the area from which the magnetic particles 22 could otherwise be directly conveyed to the regulating portion Z.

In this embodiment, those plates, which were large enough in the aforementioned dimensions to be effective for preventing the aforementioned unsatisfactory coating, were employed as the shielding members 29, and were assembled into the magnetic brush type charging apparatus 2 to carry out an image forming operation. When this charging apparatus 2 was used for image formation, the stirring member 28 was successful in preventing certain portions of the magnetic brush from being excessively contaminated by toner particles; the stirring member 28 was successful in preventing the toner particles from excessively accumulating in certain portions of the magnetic brush portion. In other words, the shielding member 29 was successful in preventing the magnetic particles from being unsatisfactorily coated as the magnetic brush portion, making it possible to reliably form images of good quality.

Embodiment 5

Figure 8:
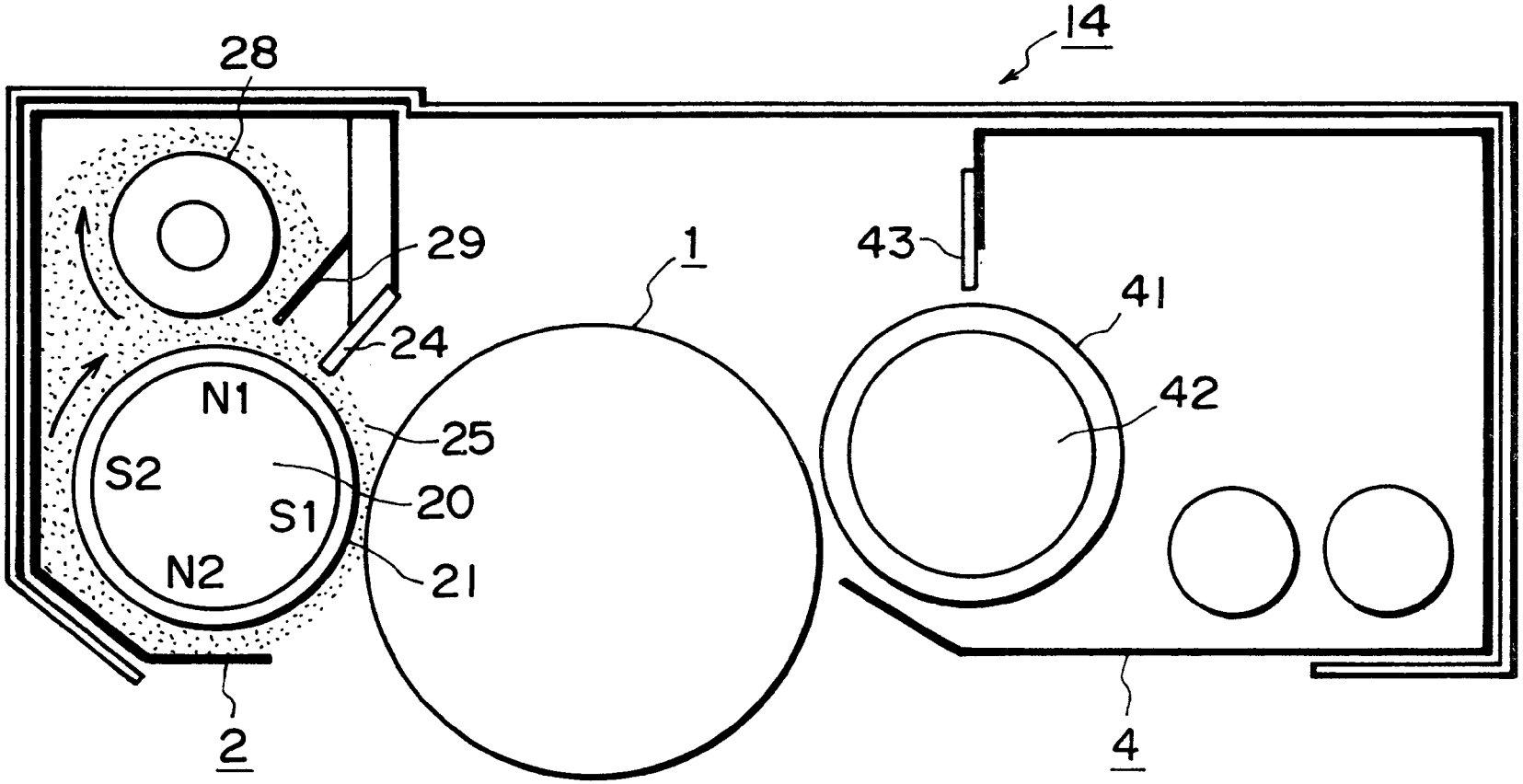
FIG. 8 is a schematic sectional view of a process cartridge equipped with the charging apparatus in FIG. 7.

This embodiment regards a process cartridge removably installable in the main assembly of an image forming apparatus. FIG. 8 is a schematic sectional view of the process cartridge 14 in this embodiment, and depicts the general structure thereof. The process cartridge 14 is a cartridge which is removably installable in the main assembly of an image forming apparatus, and in which three processing means for image formation, which are a photosensitive member 1 as an image bearing member, a charging apparatus 2 for charging the photosensitive drum 1, and a developing apparatus 4, are integrally placed. As for the charging apparatus 2, a charging apparatus similar to the one used in the fourth embodiment is employed.

In the fourth and fifth embodiments, the shielding member 29 independent from the shell portion (container) 23 of the charging apparatus is fixed to the shell portion 23 of the charging apparatus. However, the shielding member 29 may be formed as an integral part of the shell portion 23 of the charging apparatus.

Miscellanies

1) The selection of the magnetic brush type charging member (charge injection device) as a contact charging member does not need to be limited to a rotational sleeve type. For example, a magnet roller may be rotated instead of the sleeve. In such a case in which a magnetic roller is rotated, the peripheral surface of a portion of the magnetic roller is rendered electrically conductive as a power supply electrode, as necessary, and electrically conductive magnetic particles are directly coated on the peripheral surface of the magnetic roller to be confined in the form of a magnetic brush, or a magnetic roller is put through a fixedly disposed charge sleeve to be rotated so that a magnetic brush is formed of the magnetic particles, and is conveyed along the peripheral surface of the fixedly disposed charge sleeve as the magnetic roller is rotated.

2) From the standpoint of the efficiency with which a photosensitive member as an image bearing member is charged by charge injection, and the prevention of ozone generation, the photosensitive member is desired to be provided with a surface layer with low electrical resistance; in other words, it is desired to be in a range of $10^9$–$10^{14}$ Ω·cm in surface resistance. Further, an organic photosensitive member other than the aforementioned ones may be employed as an image bearing member. In other words, the selection of a contact charging system does not need to be limited to the charge injection systems in the preceding embodiments. For example, it may be a contact charging system in which electrical discharge plays a dominant role.

3) In the preceding sections of this document, a developing apparatus was described with reference to the so-called two component developing method. However, the present invention is also applicable to developing methods other than the above described one. Among the other developing methods, a single component contact developing method, or a two component contact developing method, in which a latent image is developed by placing developer in contact with a photosensitive member, is preferable because both are effective to improve the efficiency which developer is recovered through a process in which a latent image is developed.

If compound toner particles are used as the toner particles for developer, the toner particles can be satisfactorily recovered not only when the aforementioned single or two component contact developing method is used, but also when a single or two component noncontact developing method, that is, a developing method other than the aforementioned ones, is employed.

A developing method may be of either a reversal development type or a normal development type.

4) The waveform of AC voltage is optional; it may be sinusoidal, rectangular, triangular, or the like. It may be a rectangular waveform created by periodically turning on and off DC current. In other words, any AC voltage may be used as a component of the bias applied to the magnetic brush portion of a charging apparatus, as long as its voltage value periodically changes.

5) The selection of the image formation process to be employed by an image forming apparatus is optional; it does not need to be limited to the apparatuses employed in the preceding embodiments. An image forming apparatus may be provided with auxiliary processing devices as necessary. An image forming apparatus does not need to be a cleanerless type apparatus. An image forming apparatus does not need to be a transfer type apparatus; it may be a direct type apparatus.

The selection of an image exposing means for forming an electrostatic latent image does not need to be limited to an exposing means, such as the one employed in the preceding embodiment, which projects a scanning laser beam to form a digital latent image. For example, it may be an ordinary analog exposing means, a light emitting element such as an LED or the like, or a combination of a light emitting element, such as a fluorescent light, and a liquid crystal shutter. In other words, it may be any exposing means as long as it can form an electrostatic latent image accurately reflecting image formation information.

The image bearing member may be an electrostatically recordable dielectric member or the like. When an electrostatically recordable dielectric member is employed, first, the surface of this dielectric member is uniformly charged (primary charging) to predetermined polarity and potential level, and then, the charge on the surface of the dielectric member is selectively removed by a charge removing means, such as an electron gun, to form (write) an intended electrostatic latent image.

6) The medium onto which a toner image is transferred from an image bearing member may be an intermediary transfer member, such as an intermediary transfer drum or an intermediary transfer belt.

7) The selection of a transferring means does not need to be limited to the transfer roller used in the preceding embodiments; it is optional. For example, it may be a corona type charging device (corona discharge transfer), a transfer belt, an electrically conductive brush, an electrically conductive blade, or the like.

8) In the preceding embodiments, the present invention was described with reference to a monochromatic image forming apparatus and its image forming process. However, the present invention is also applicable to a full-color image forming apparatus, in which a combination of a photosensitive member, a charging apparatus, a developing apparatus, and an exposing apparatus, is provided for each of the color components (for example, yellow, magenta, cyan, and black), and the toner image on the photosensitive member in each combination is sequentially transferred onto a piece of transfer medium borne on a transfer medium bearing member, in the form of a cylinder or a belt, to form a full-color image.

In other words, not only is the present invention applicable to a monochromatic image forming apparatus, but also it is applicable to a full-color image forming apparatus capable of forming a multicolor image or a full-color image through a multilayer transfer process, or the like, which employs an intermediary transfer member such as a transfer drum or a transfer belt.

9) There are image displaying apparatuses in which the electrophotographic photosensitive member or electrostatically recordable dielectric member, as an image bearing member, is in the form of a rotational belt, on which a toner image in accordance with image formation information is formed through a charging process, an electrostatic image forming process, and a developing process. Further, the area of the image bearing member, across which the toner image is formed, is aligned with the display window with which they are provided, so that the toner image can be seen or read through the window. The image bearing member is repeatedly used for forming images to be displayed. These image displaying apparatuses are also included among the image forming apparatuses to which the present invention is applicable.

While the invention has been described with reference to the structures disclosed herein, it is not confined to the details set forth, and this application is intended to cover such modifications or changes as may come within the purposes of the improvements or the scope of the following claims.

What is claimed is:

1. A charging apparatus comprising:

magnetic particles for rubbing with a member to be charged to electrically charge the member to be charged;

a rotatable magnetic particle carrying member for carrying the magnetic particles by magnetic force; and a stirring member, provided above said magnetic particle carrying member, for stirring the magnetic particles, said stirring member moving in a direction opposite from a movement direction of said magnetic particle carrying member at a position where said stirring member is opposed to said magnetic particle carrying member, wherein said magnetic particle carrying member contains therein a stationary magnet having a plurality of magnetic poles, and a position where said stirring member is closest to said magnetic particle carrying member is substantially between magnetic poles having the same polarity.

2. A charging apparatus comprising:

magnetic particles for rubbing with a member to be charged to electrically charge the member to be charged;

a rotatable magnetic particle carrying member for carrying the magnetic particles by magnetic force; and a stirring member, provided above said magnetic particle carrying member, for stirring the magnetic particles, said stirring member moving in a direction opposite from a movement direction of said magnetic particle carrying member at a position where said stirring member is opposed to said magnetic particle carrying member, wherein a bank of magnetic particles is formed and is taller than a rotational center of said stirring member and not taller than a highest point thereof.

3. A charging apparatus comprising:

magnetic particles for rubbing with a member to be charged to electrically charge the member to be charged;

a rotatable magnetic particle carrying member for carrying the magnetic particles by a magnetic force;

a stirring member, provided above said magnetic particle carrying member, for stirring the magnetic particles, said stirring member moving in the direction opposite from a movement direction of said magnetic particle carrying member at a position where said stirring member is opposed to said magnetic particle carrying member;

a layer thickness regulating member for regulating a layer thickness of the magnetic particles carried on said magnetic particle carrying member; and a limiting member for limiting an amount of magnetic particles supplied to a regulating position of said regulating member from said stirring member, between said stirring member and said regulating member.

4. Apparatus according to claim 3, wherein a free end of said limiting member is beyond a tangent line of said stirring member passing through the regulating position, toward said magnetic particle carrying member.

5. An apparatus according to claims 4, wherein a free end of said limiting member is beyond a line connecting centers of said regulating member and said stirring member, toward said magnetic particle carrying member.

6. A charging apparatus comprising:

magnetic particles for rubbing with a member to be charged to electrically charge the member to be charged;

a rotatable magnetic particle carrying member for carrying the magnetic particles by a magnetic force; and a stirring member, provided above said magnetic particle carrying member, for stirring the magnetic particles, wherein said magnetic particle carrying member contains therein a stationary magnet having a plurality of magnetic poles, and a position where said stirring member is close to said magnetic particle carrying member is substantially between magnetic poles having the same polarity.

7. A charging apparatus comprising:

magnetic particles for rubbing with a member to be charged to electrically charge the member to be charged;

a rotatable magnetic particle carrying member for carrying the magnetic particles by a magnetic force; and a stirring member, provided above said magnetic particle carrying member, for stirring the magnetic particles, wherein a bank of magnetic particles is formed and is taller than a rotational center of said stirring member.

8. A charging apparatus comprising:

magnetic particles for rubbing with a member to be charged to electrically charge the member to be charged;

a rotatable magnetic particle carrying member for carrying the magnetic particles by a magnetic force;

a stirring member for stirring the magnetic particles;

a layer thickness regulating member for regulating a layer thickness of the magnetic particles carried on said magnetic particle carrying member; and a limiting member for limiting an amount of magnetic particles supplied to a regulating position of said regulating member from said stirring member, between said stirring member and said regulating member.

9. An apparatus according to claim 8, wherein a free end of said limiting member is beyond a tangent line of said stirring member passing through the regulating position, toward said magnetic particle carrying member.

10. An apparatus according to claim 9, wherein a free end of said limiting member is beyond a line connecting centers of said regulating member and said stirring member, toward said magnetic particle carrying member.

* * * * *

UNITED STATES PATENT AND TRADEMARK OFFICE

CERTIFICATE OF CORRECTION

PATENT NO. : 6,381,431 B1
DATED : April 30, 2002
INVENTOR(S) : Masahide Kinoshita et al.

It is certified that error appears in the above-identified patent and that said Letters Patent is hereby corrected as shown below:

Column 2,
Line 10, "particle" should read -- particles --.

Column 4,
Line 38, "mixed" should read -- is mixed --.

Column 6,
Line 18, "referential code" should read -- reference numeral --;
Line 26, "or," should read -- or --; and
Line 38, "is" should read -- is, --.

Column 8,
Line 8, "Opposite" should read -- opposite --;
Line 57, "portico" should read -- portion --; and
Line 58, "and in" should read -- and is --.

Column 9,
Line 12, "particles)." should read -- particles) 22 in the apparatus 2, and then, are ejected onto the photosensitive drum 1. --; and
Line 62, "Is sat" should read -- is set --.

Column 10,
Line 2, "portion." should read -- portion). --;
Line 6, "photo sensitive" should read -- photosensitive --;
Line 11, "an" should read -- as --;
Line 27, "Particles," should read -- particles, --; and "possible'" should read -- possible --;
Line 29, "Is" should read -- is --;
Line 34, "an" should read -- as --;
Line 38, "in" should read -- is --; and
Line 61, "28ais" should read -- 28a is --.

UNITED STATES PATENT AND TRADEMARK OFFICE

CERTIFICATE OF CORRECTION

PATENT NO. : 6,381,431 B1
DATED : April 30, 2002
INVENTOR(S) : Masahide Kinoshita et al.

It is certified that error appears in the above-identified patent and that said Letters Patent is hereby corrected as shown below:

Column 11,
Line 31, "an" should read -- on --;
Line 34, "Is" should read -- is --;
Line 49, "am" should read -- are --; and
Line 50, "in" should read -- is --.

Column 12,
Line 13, "member 26" should read -- member 28 --;
Line 21, "become" should read -- becomes --;
Line 42, "mew or" should read -- member --;
Line 44, "reaches if" should read -- reaches. If --;
Line 45, "member 26," should read -- member 28, --;
Line 50, "member" should read -- member 28 --; and
Line 63, "of, the" should read -- of the --.

Column 13,
Line 13, "stared" should read -- stored --;
Line 17, "sleeve 12" should read -- sleeve 21 --; and
Line 55, "apparatus" should read -- apparatus, --.

Column 14,
Line 11, "an the" should read -- on the --;
Line 43, "halt" should read -- half --; and
Line 47, "beer" should read -- bear --.

Column 15,
Line 7, "or the" should read -- of the --;
Line 10, "Photosensitive" should read -- photosensitive --; and
Lines 15 through 25 should deleted.

UNITED STATES PATENT AND TRADEMARK OFFICE

CERTIFICATE OF CORRECTION

PATENT NO. : 6,381,431 B1
DATED : April 30, 2002
INVENTOR(S) : Masahide Kinoshita et al.

It is certified that error appears in the above-identified patent and that said Letters Patent is hereby corrected as shown below:

Column 17,
Line 12, "charge" should read -- the charge --; and
In Table 1, "occurred" should read -- occurs --.

Column 18,
In Table 1, "bad-coating occurs" should read -- bad-coatings occur --; and
Line 59, "were" should read -- was --.

Column 20,
Line 14, "which" should read -- with which --.

Column 22,
Line 37, "Apparatus" should read -- An apparatus --; and
Line 41, "claims" should read -- claim --.

Signed and Sealed this

First Day of October, 2002

*Attest:*

*Attesting Officer*

JAMES E. ROGAN
*Director of the United States Patent and Trademark Office*